US005083248A

United States Patent [19]

Troy

[11] Patent Number: 5,083,248

[45] Date of Patent: Jan. 21, 1992

[54] METHOD AND APPARATUS FOR RETROFITTING FLUSH MOUNT TRIM TO EXISTING RECESSED LIGHT FIXTURE

[75] Inventor: Marc A. Troy, Forest Hills, N.Y.

[73] Assignee: Fredrick Ramond, Inc., Cerritos, Calif.

[21] Appl. No.: 462,815

[22] Filed: Jan. 10, 1990

[51] Int. Cl.[5] ..... F21S 1/02

[52] U.S. Cl. ..... 362/147; 362/364; 362/457

[58] Field of Search ..... 362/147, 148, 150, 364, 362/365, 366, 457

[56] References Cited

U.S. PATENT DOCUMENTS

| | | | |
|---|---|---|---|
| 2,997,575 | 8/1961 | Schwartz | 362/364 |
| 3,609,346 | 9/1971 | Lund et al. | 362/364 |
| 3,692,977 | 9/1972 | Duhamel et al. | 362/147 X |
| 4,424,554 | 1/1984 | Woloski et al. | 362/150 |
| 4,450,512 | 5/1984 | Kristofek | 362/364 |
| 4,712,168 | 12/1987 | Scherrer | 362/150 X |

*Primary Examiner*—Carl D. Price
*Assistant Examiner*—Richard R. Cole
*Attorney, Agent, or Firm*—Blakely, Sokoloff, Taylor & Zafman

[57] ABSTRACT

A method and apparatus for overcoming the cost and time penalties associated with replacing recessed lighting fixtures with flush mount lighting fixtures by using a flush mount trim, which in effect, is a flush mount lighting fixture from which the electrical wiring, lamp, socket and mounting hardware has been removed. The flush mount trim, using a pair of expansion springs, is coupled to the recessed lighting fixture. One or more socket extenders are added to the existing socket in the recessed lighting fixture depending upon the length of the bulb to be used in connection with the flush mount trim.

4 Claims, 5 Drawing Sheets

METHOD AND APPARATUS FOR RETROFITTING FLUSH MOUNT TRIM TO EXISTING RECESSED LIGHT FIXTURE

BACKGROUND OF THE INVENTION

1. Field of the Invention

The present invention is directed to a method and apparatus for converting an existing recessed lighting fixture into what appears to be a flush mount lighting fixture.

2. Description of the Prior Art

Recessed lighting fixtures and flush mount lighting fixtures are well known devices which are utilized in residential and commercial buildings to provide room lighting and a decorative accent. Recessed lighting fixtures are lighting fixtures which are recessed into a ceiling such that excepting for the base of the bulb and a border trim, no portion of the lighting fixture may be seen below the plane of the ceiling. Recessed lighting fixtures are typically coupled directly to the electrical system of a building without the use of a previously installed junction box since the components of the recessed lighting fixture itself occupy the same space that would be occupied by an installed junction box.

Flush mount lighting fixtures are lighting fixtures which mount flush with a ceiling, but include elements which extend down below the plane of the ceiling. Flush mount lighting fixtures are similar to hanging light fixtures and chandeliers in that they are both coupled to the electrical system of a building through a previously installed junction box. Flush mount lighting fixtures differ from hanging lighting fixtures and chandeliers in that flush mount fixtures do not include chains, cables, or other elements which provide an appearance of a freely hanging fixture wherein the connection point between the fixture and the ceiling may operate as a pivot.

As noted above, both hanging fixtures and flush mount fixtures are coupled to a building electrical system through a junction box. A junction box is simply a housing mounted above the ceiling plane and incorporating electrical wiring for connection to a lighting fixture as well as components for securely mounting the junction box to ceiling beams or other secure structural building elements. In this manner, in addition to providing a source of electrical power to a lighting fixture, the lighting fixture is also coupled to the junction box so that the lighting fixture is securely held in place.

On the other hand, if at the time a room is being designed, it is determined that a particular lighting fixture is to be a recessed lighting fixture, then the junction box is eliminated and the recessed lighting fixture is built directly into the ceiling. That is, a recessed lighting fixture is directly coupled to the building electrical system and a structural support element such that the function performed by the junction box is performed by the recessed lighting fixture itself.

The technique of utilizing a junction box for hanging a flush mount lighting fixtures and not utilizing a junction box for recessed lighting fixtures is adequate for initial installation and for remodeling provided that all recessed lighting fixtures remain recessed lighting fixture and all hanging or flush mount lighting fixtures remain hanging or flush mount lighting fixtures. However, if it is desired to convert a recessed lighting fixture to a flush mount lighting fixture, in the prior art, it is necessary to (i) remove the recessed lighting fixture from the ceiling; (ii) install a junction box; and (iii) connect the flush mount lighting fixture to the installed junction box. However, this approach not only requires the expense associated with purchasing one junction box for each recessed lighting fixture to be replaced, but also substantial labor costs and extra time to remove the recessed lighting fixture and install the junction box in its place.

SUMMARY OF THE INVENTION

The present invention overcomes the cost and time penalties associated with replacing recessed lighting fixtures with flush mount lighting fixtures by using what is referred to herein as flush mount trim, which in effect, is a flush mount lighting fixture from which the electrical wiring, lamp, socket and mounting hardware has been removed. The flush mount trim, using a pair of expansion springs, is coupled to the recessed lighting fixture. One or more socket extenders are installed depending upon the length of the bulb to be used in connection with the flush mount trim.

DETAILED DESCRIPTION OF THE INVENTION

The present invention is directed to a method and apparatus for converting an existing recessed lighting fixtures into what appears to be a flush mount lighting fixture.

Figure 1:
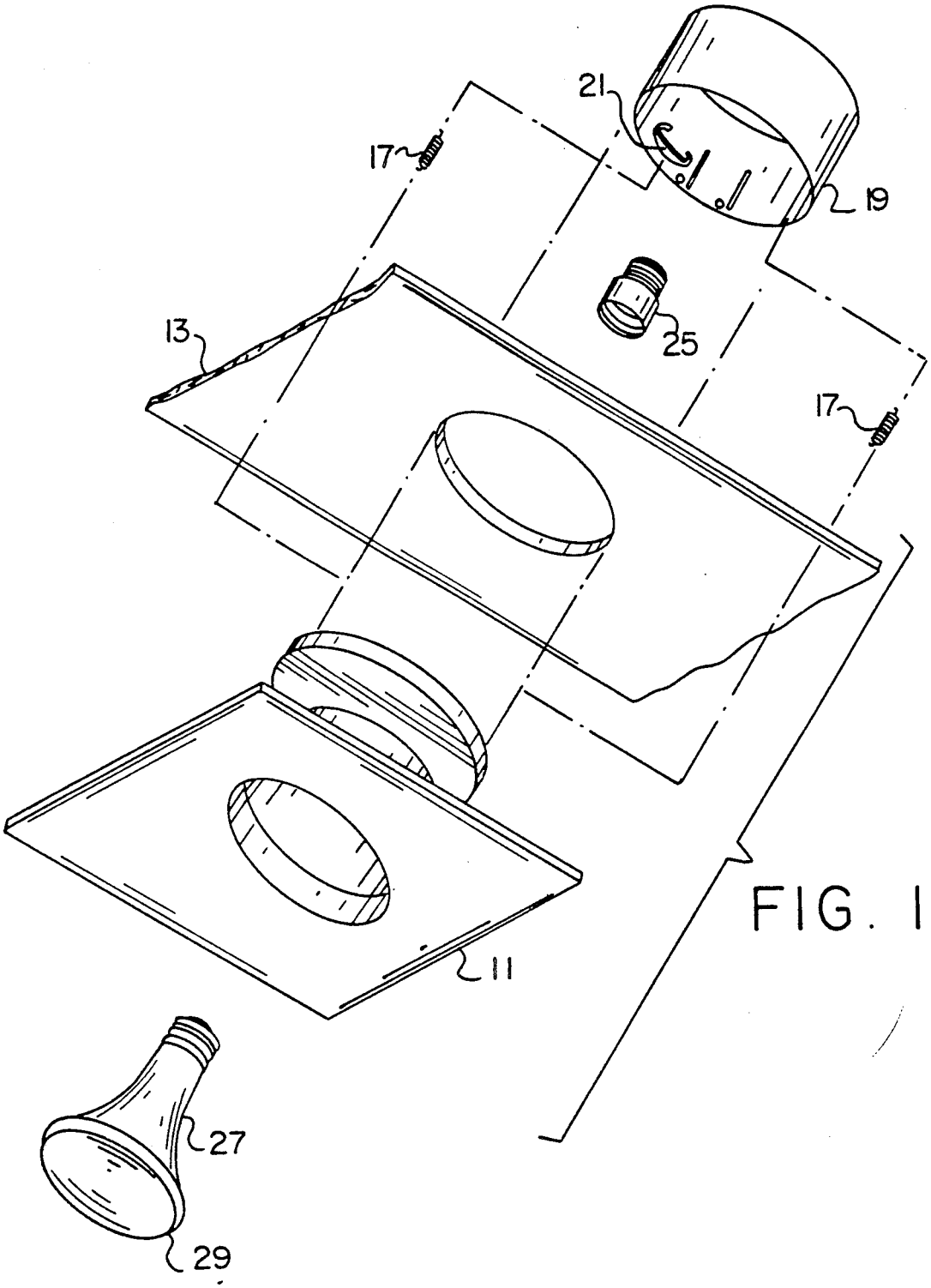
FIG. 1 is a perspective exploded view illustrating the present invention.

Referring to FIG. 1, which is an exploded perspective view, the invention comprises flush mount trim 11 which is mounted flush to a ceiling 13 by expansion springs 17 coupling trim 11 to an existing recessed lighting fixture 19. Recessed lighting fixture 19 itself is mounted to a beam or other structural building element (not shown) and incorporates a pair of brackets 21 (only one of which is shown in FIG. 1) or other connection element such than one end of spring 17 is coupled to one bracket 21 of recessed lighting fixture 19 and the other end of spring 17 is coupled to trim 11. A second spring 17 couples a bracket opposite to bracket 21 shown in FIG. 1 to a corresponding portion of trim 11. Bracket 21 is an integral part of recessed lighting fixture 19 and is used to couple border trim which may be used to cover an exposed gap between the recessed lighting fixture and the ceiling. The recessed lighting fixture includes a socket (not shown) which is coupled to a building's electrical wiring which is also not shown. A socket extender 25 is screwed into the recessed lighting fixture socket and a bulb 27 is screwed into the socket extender such that the face 29 of the bulb extends to a desired position within flush mount trim 11. If necessary, additional socket extenders 25 may be added so that the face of the bulb is placed at the desired position.

Figure 2:
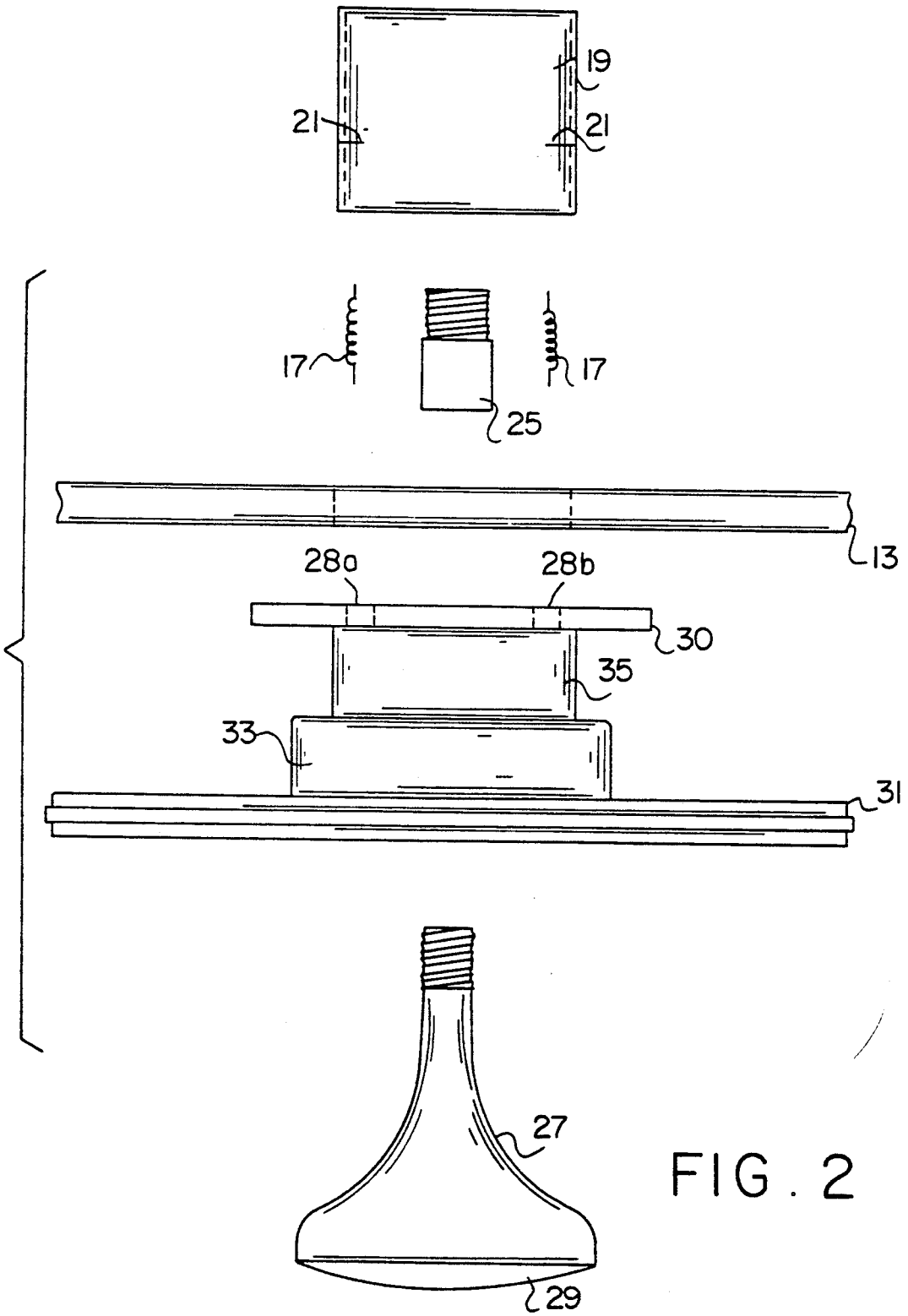
FIG. 2 is a side elevation exploded view illustrating the present invention.
Figure 3:
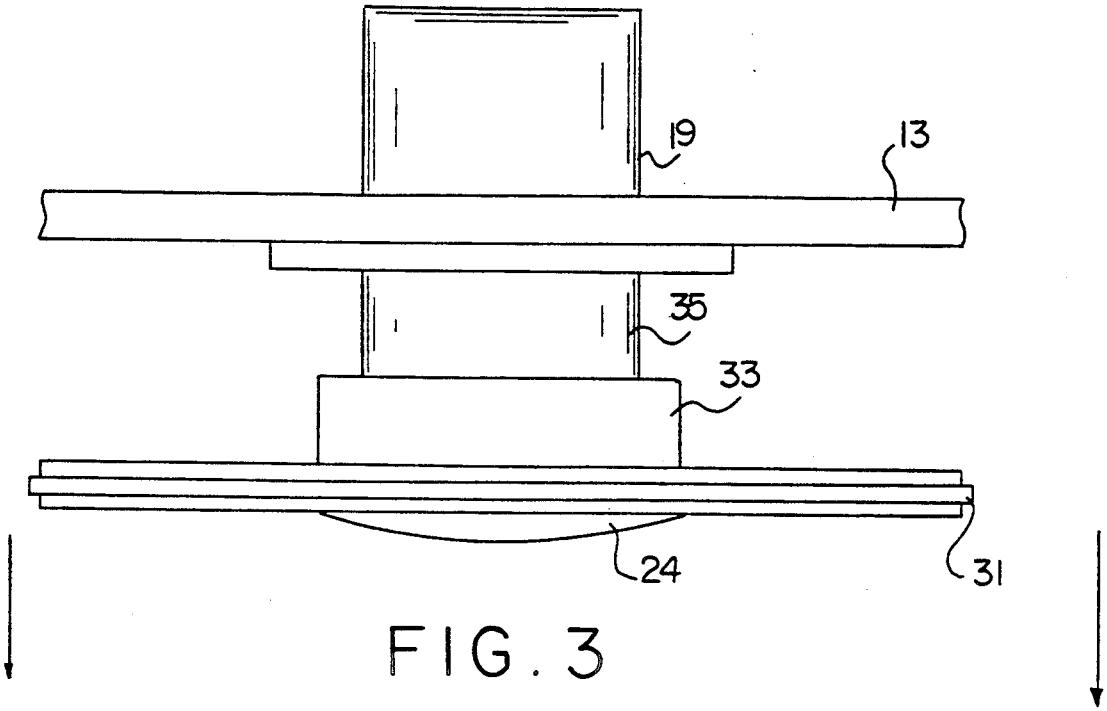
FIG. 3 is a side elevation view thereof.

FIG. 2 is an exploded elevation view wherein the recessed lighting fixture 19 is shown in partial cut-away to more clearly show brackets 21 and springs 17. FIG. 3 is a side elevation showing an existing recessed lighting fixture to which the elements comprising the present invention have been mounted to create the appearance of a flush mount lighting fixture.

Figure 4:
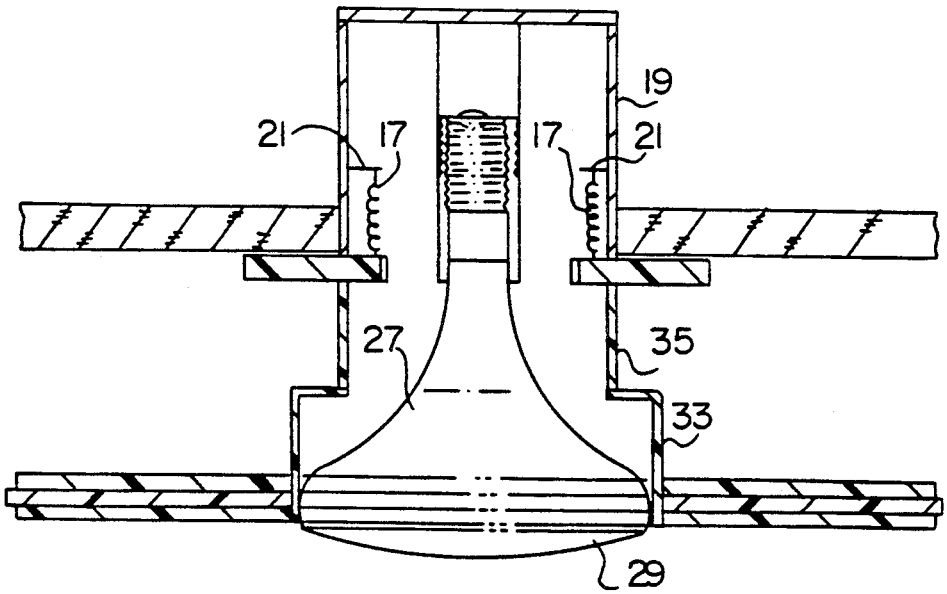
FIG. 4 is a side elevation cross sectional view thereof taken along line IV—IV of FIG. 3.

The details with respect to the coupling of the recessed lighting fixture to the flush mount trim is shown in FIG. 4 which is a cross section view taken along the line IV—IV of FIG. 3. As can be seen, each of two springs 17 are connected to a bracket 21 within the recessed lighting fixture at one end and through holes 28*a* and 28*b* in base plate 30 to hold the flush mount trim flush against ceiling 13. Of course, to holes 28*a* and 28*b* for each spring 17 may comprise any means for attaching an end of spring 17 to base plate 30.

Figure 5:
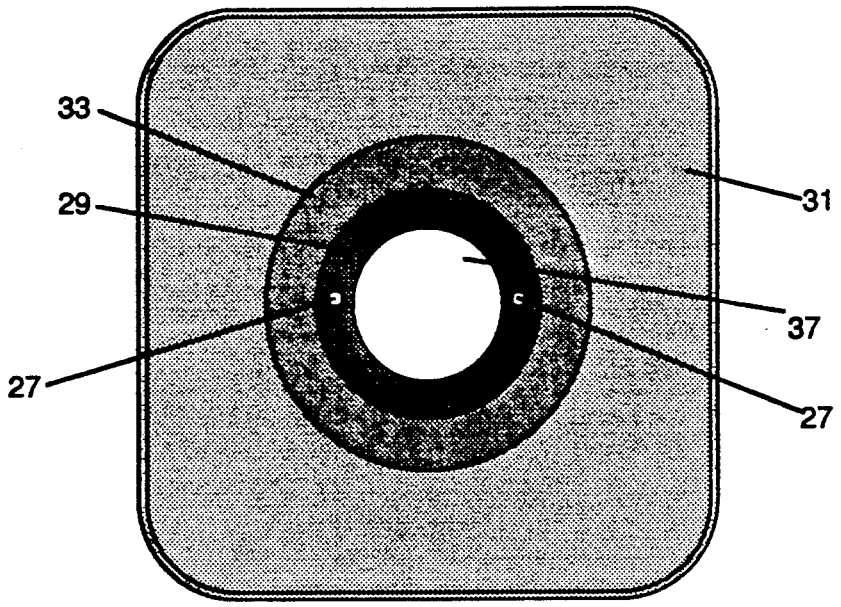
FIG. 5 is a bottom plan view of flush mount trim 11.
Figure 6:
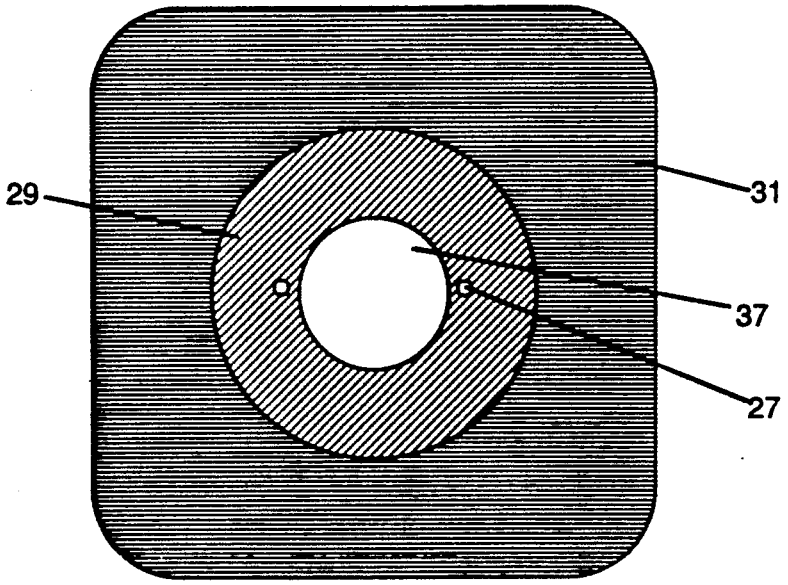
FIG. 6 is a top plan view of flush mount trim 11.

Further details concerning the location of holes 28*a* and 28*b* in base plate 30 may be better seen in FIGS. 5 and 6 which are respectively bottom and top plan views of trim 11. Of course, trim 11 may be configured in any desired matter, the only limitation being a requirement that there be holes 28*a* and 28*b* or other means for coupling springs 17 to brackets 21 within recessed lighting fixture 19.

In particular, referring first to the bottom view (i.e., the bottom of the trim in its installed position) of flush mount trim 11 shown in FIG. 5 (as well as FIG. 6), bulb 27 has been removed so that the inside of flush mount trim 11 can be seen. In this connection, as shown in FIG. 5, flush mount trim 11 comprises face plate 31, first decorative column 33, second decorative column 35 (which cannot be seen in FIGS. 5 and 6) and base plate 30 with mounting holes 28*a* and 28*b*. The top plan view shown in FIG. 6 is similar excepting that base plate 30 covers the first and second decorative columns. Of course, decorative columns 33 and 35, face plate 31 as well as base plate 30 may be of any design, the only requirement being that base plate 30 include holes 27 or other mounting means for springs 17.

In this connection, springs 17 which are used to connect flush mount trim 11 to brackets 21 of the recessed lighting fixture are installed through opening 37 as follows. First, the springs are attached to bracket 21 such that the end which is to be coupled to flush mount trim 11 can be reached through opening 37 by a hand, a pair of pliers or other tool. The spring is pulled such that the free end is engaged into holes 28*a* and 28 *b*, there being one spring coupling each bracket 21 hole 28*a* and 28*b* pan. Additionally, socket extender 11 is usually installed before flush mount trim 25 is installed, although the socket extender or extenders may be mounted afterwards if the socket in the recessed lighting fixture can be reached after the flush mount trim has been installed.

Figure 7:
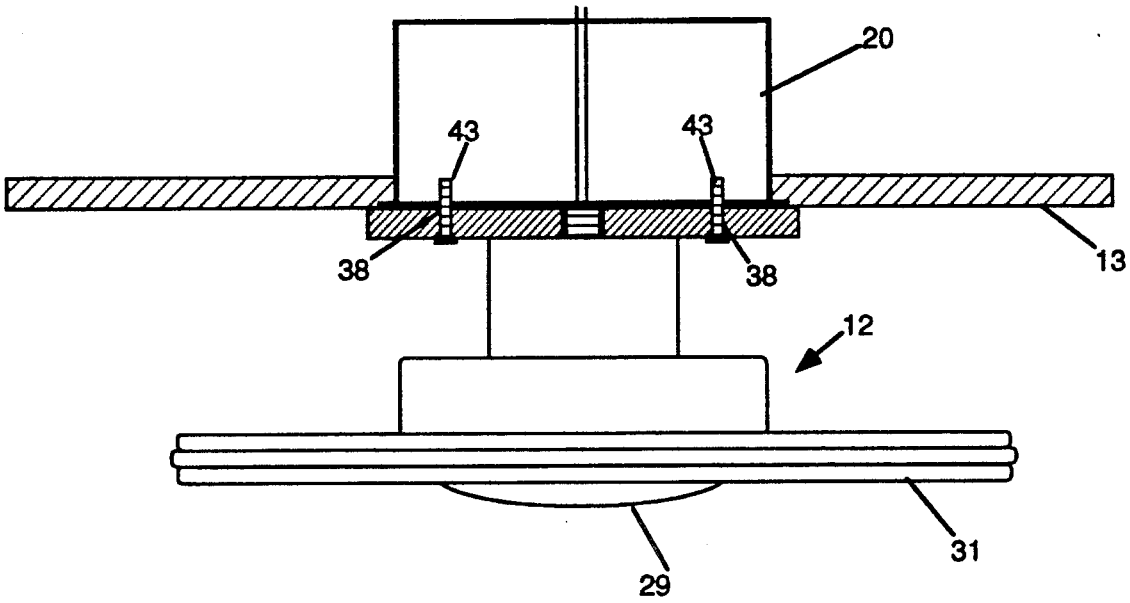
PRIOR ART Fig. 7
FIG. 7 is a side elevation of a prior art flush mount lighting fixture in partial cutaway.

The foregoing is to be contrasted with the installation of prior art flush mount lighting fixtures shown, for example, in FIG. 7 wherein lighting fixture 12 is similar to flush mount trim 11 in that it incorporates face plate 31, first and second decorative columns 33 and 35 and base plate 30. As shown in FIG. 7, lighting fixture 12 is mounted flush to ceiling 13 by connection to a junction box 20 which includes wiring (not shown) for coupling to the room lighting system which is also not shown. Function box 20 itself is coupled to a secure building structural element such as a ceiling beam which is not shown in FIG. 7. Flush mount lighting fixture 12 also includes a socket (not shown) for a bulb as well as holes 38 through which screws 43 are inserted for bolting fixture 12 to junction box 20.

Thus, it should be apparent that by using the present invention, substantial time and expense can be saved by retro fitting existing recessed lighting fixtures with lighting fixture trim according to the present invention, rather than removing a previously installed recessed lighting fixture, replacing it with a junction box and bolting a flush mount lighting fixture to the junction box.

Although a particular embodiment of the invention has been described, such particular description is not intended to limit the scope of the invention as defined in the following claims.

I claim:

1. An apparatus for converting a recessed lighting fixture having bracket means installed within a ceiling to a flush mount lighting fixture comprising:

(a) trim member having the appearance of a flush mount light fixture;

(b) a substantially vertically disposed spring means having a first end coupled to said trim member and a second end for coupling to said bracket means;

(c) at least one socket extender for coupling to a socket within said recessed lighting fixture and for receiving a light bulb.

2. The apparatus defined by claim 1 wherein said spring means comprises a pair of expansion springs, each having one end coupled to a corresponding mounting hole within said trim member.

3. A method for converting a recessed lighting fixture having at least one bracket, said recessed lighting fixture installed within a ceiling, to a flush mount lighting fixture comprising the steps of:

(a) removing from said recessed lighting fixture a recessed lighting fixture border trim coupled to said at least one bracket by at least one substantially vertically disposed spring;

(b) producing a trim member having the appearance of a flush mount light fixture;

(c) coupling a first end of said at least one spring to said trim member;

(d) installing at least one socket extender into a socket within said recessed lighting fixture, said socket extender for receiving a light bulb; and (e) coupling a second end of said at least one spring to said at least one bracket.

4. The method defined by claim 3 wherein said trim member is coupled to said recessed lighting fixture by a pair of springs coupling a pair of brackets within said recessed lighting fixture to a corresponding pair of mounting holes within said trim member.

* * * * *